United States Patent [19]

Johnston et al.

[11] 4,195,673

[45] Apr. 1, 1980

[54] FUEL TANK FILL TUBE WITH A MAGNETICALLY ACTUATED VALVE

[75] Inventors: Richard W. Johnston, Troy; John G. Neuman, Grosse Pointe Woods; Thaddeus Schroeder, Sterling Heights, all of Mich.; Norman L. Traub, Cortland, Ohio

[73] Assignee: General Motors Corporation, Detroit, Mich.

[21] Appl. No.: 961,951

[22] Filed: Nov. 20, 1978

[51] Int. Cl.[2] ..... B65B 3/04

[52] U.S. Cl. ..... 141/349; 141/DIG. 1; 251/65

[58] Field of Search ..... 141/206-210, 141/198, 290, 346-350, 392, DIG. 1; 220/86 R, 230; 251/65, 149.6

[56] References Cited

U.S. PATENT DOCUMENTS

| | | | |
|---|---|---|---|
| 2,405,127 | 8/1946 | Beach | 137/139 |
| 3,521,679 | 7/1970 | Copony | 141/208 |
| 3,897,810 | 8/1975 | Arnett et al. | 141/346 |
| 3,900,056 | 8/1975 | Giardini et al. | 141/290 X |
| 4,034,784 | 7/1977 | Ball et al. | 141/348 |

*Primary Examiner*—Frederick R. Schmidt
*Attorney, Agent, or Firm*—Donald F. Scherer

[57] ABSTRACT

A fuel tank fill tube has a telescoping valve element slidably disposed on a tubular portion thereof. The fill tube and valve element are nonmagnetic. An iron collar is secured to one end of the valve such that on insertion of a magnet carrying fuel nozzle into the fill tube, the valve is opened by magnetic forces between the collar and the magnet to permit fuel flow into the tank. The valve is urged in the closing direction by a spring.

2 Claims, 3 Drawing Figures

FUEL TANK FILL TUBE WITH A MAGNETICALLY ACTUATED VALVE

This invention relates to fuel tank fill tube valves and more particularly to such valves that are magnetically actuated.

Since service stations still dispense both leaded and unleaded gasoline, and in the near future will most likely be dispensing more diesel fuel, it is necessary for the vehicle fuel tank to be protected so that the incorrect type of fuel will not be dispensed into the tank. This is presently accomplished by providing a smaller diameter nozzle on the fuel pump which dispenses unleaded gasoline. Vehicles requiring unleaded gasoline have a smaller diameter fill tube such that the leaded fuel nozzle cannot be inserted into the fill tube. This system is a deterent which prevents the majority of the public from dispensing leaded fuel into a vehicle tank requiring unleaded fuel.

The present invention seeks to increase the difficulty accompanying the dispensing of leaded fuel into a vehicle tank requiring unleaded fuel. This is accomplished by providing a valve mechanism within the fuel tank fill tube which valve can only be opened by a fuel dispensing nozzle having a magnet attached thereto so that valve opening is automatic. The opening into which the fuel nozzle is inserted is dimensioned such that a leaded fuel nozzle cannot be inserted into the fill tube if a magnet is attached thereto.

It is therefore an object of this invention to provide an improved fuel fill tube having a magnetically actuated valve for accepting only fuel dispensed from a nozzle having a magnet attached thereto for opening the valve.

It is another object of this invention to provide an improved fuel fill valve which is telescoped on the fuel fill tube and has a magnetic collar adjacent one end of the valve such that the valve is opened to permit fuel flow into the fuel tank only when a dispensing nozzle carrying a magnet is inserted into the fill tube.

These and other objects and advantages of the present invention will be more apparent from the following description and drawings in which.

Figure 1:
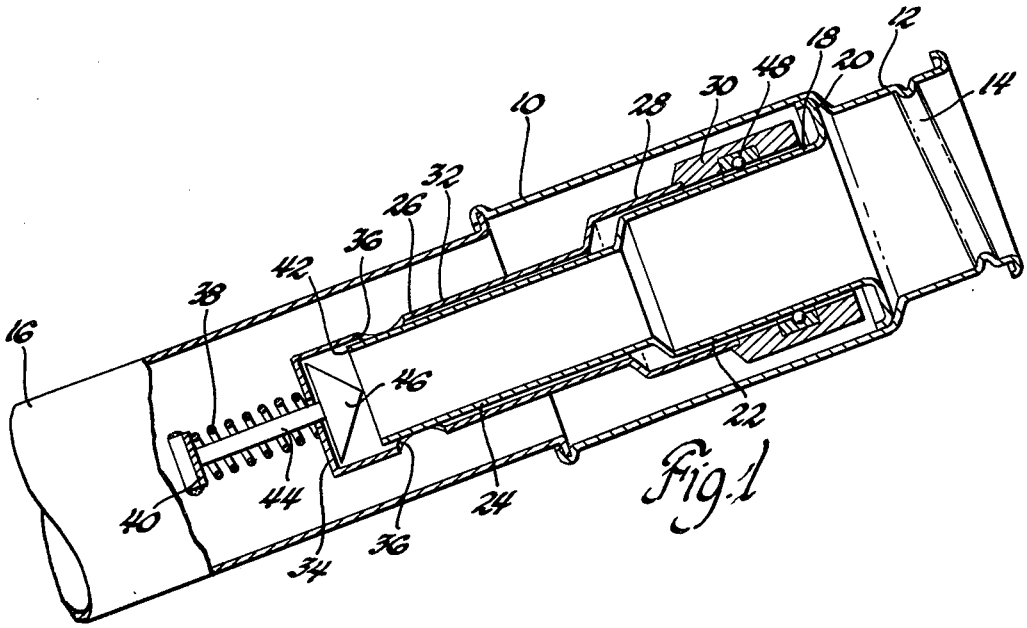
FIG. 1 is a cross sectional view of a fuel fill tube and valve assembly showing the valve in the closed position.

Referring to the drawings, there is seen a fuel fill tube assembly having an outer tubular member 10 which has formed on one end 12, a threaded portion 14 to which is adapted to receive a fuel cap, not shown. The other end 16 of the outer tube 10 is adapted to be connected, in a conventional manner, to a fuel tank, not shown. A stepped diameter tubular member 18 is secured at one end 20 to the outer tube 10 and extends coaxially with the outer tube 10. The tubular member 18 is preferably made of nonmagnetic material such as aluminum or plastic and has a large diameter cylindrical portion 22 and a small diameter cylindrical portion 24.

A valve member 26 is telescopingly disposed circumjacent the tubular member 18. The valve member 26 has a large diameter cylindrical portion 28 to which is secured an iron collar 30 and a smaller diameter cylindrical portion 32 which has a closed end 34 and a plurality of apertures or openings 36 formed through the cylindrical portion 32. The large diameter cylindrical portion 28 and iron collar 30 are disposed adjacent the cylindrical portion 22 of tubular member 18 and the cylindrical portion 32 is disposed adjacent the cylindrical portion 24, as seen in FIG. 1.

A spring 38 is compressed between a spring seat 40 and the closed end 34 to urge the telescoping member 26 upward and to the right as viewed in FIG. 1. The spring seat 40 is secured to the outer tubular member 10 and is therefore stationary relative to the telescoping member 26. As seen in FIG. 1, the spring 38 moves the telescoping member 26 to a position which places the openings 36 adjacent the outer surface of cylindrical portion 24 thereby closing the end 42 of the tubular member 18. A fuel diverter member 44 is secured to the spring seat 40 and has a conical head 46 disposed between the closed end 34 and the end 42 of tube 18.

The telescoping member 26, except for the force in spring 38, is free to telescope on the tubular member 18. A ball bearing 48 is incorporated into the collar 30 to reduce the frictional forces between the telescoping tube 26 and the tubular member 18. The spring set position of telescoping member 26 may be controlled either through contact between the closed end 34 and the lower end of conical section 46, or by any other conventional stop means such as a ring secured to the tubular member 18 or by the end 20 of tubular member 18.

The inner diameter of cylindrical portion 24 is of such a dimension that it will accept a conventional fuel nozzle used for dispensing unleaded gasoline. The inner diameter of cylindrical portion 22 is designed such that an annular magnet may be attached to the unleaded fuel dispensing nozzle. Since the inner diameter of cylindrical portion 22 is substantially larger than the inner diameter of cylindrical portion 24, a nozzle dispensing leaded fuel could be inserted into diameter 22. However, since the end 42 of tubular member 18 is closed by the telescoping member 26, any fuel dispensed from the leaded fuel nozzle would fill the tubular member 18 and enter the fuel tank at a very slow controlled rate thus discouraging common usage of leaded fuel where unleaded fuel is desirable.

Figure 2:
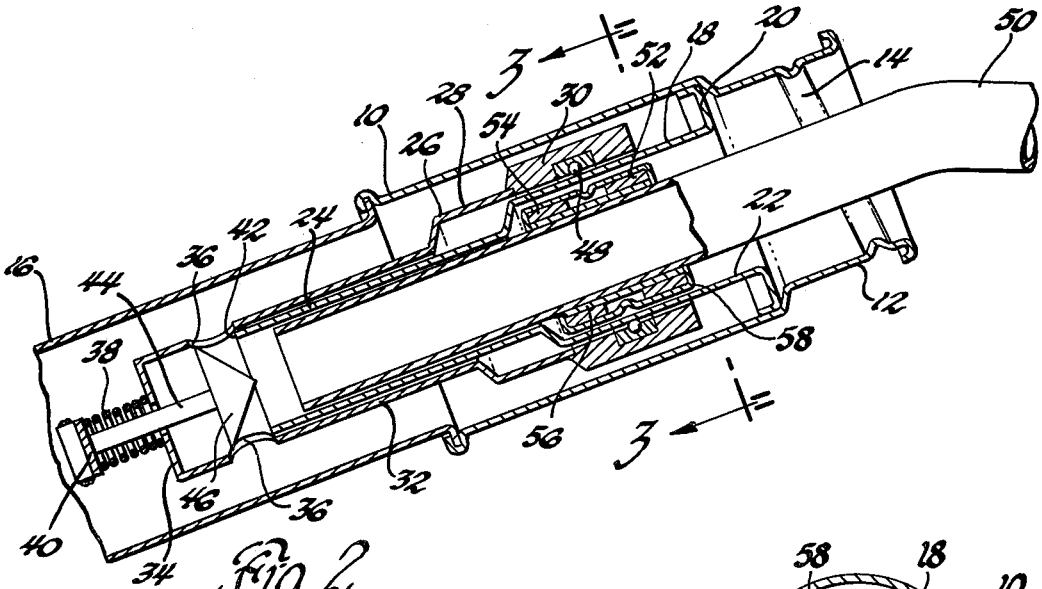
FIG. 2 is a cross sectional view of a fuel fill tube and valve assembly with a fuel dispensing nozzle inserted therein.
Figure 3:
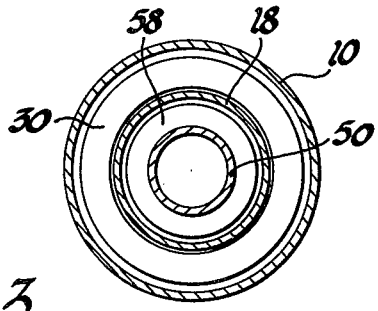
FIG. 3 is a sectional view taken along line 3—3 of FIG. 2.

However, as seen in FIG. 2, when a fuel nozzle 50 having a pair of annular magnets 52 and 54 secured thereto is inserted into the fill tube, the iron collar 30 will be attracted by and move with the magnets 52 and 54 to cause the telescoping member 26 to move in unison with the nozzle 50 against spring 38 such that the openings 36 will uncover the lower end 42 of tubular member 18. At this time, fuel dispensed from nozzle 50 will impinge on the conical section 46 and be directed through openings 36 into the outer tube 10 which is connected to the fuel tank.

To increase the magnetic field of magnets 52 and 54, an iron ring 56 is secured to the nozzle 50. To provide protection against the magnets contacting tube 18, a non-magnetic protective covering 58 is secured to the outer surface of the magnets 52 and 54. To provide a strong magnetic field, the magnets are preferably rare earth type permanent magnets and in particular, samarium cobalt magnets are considered appropriate.

When the nozzle 50 is removed from the tubular member 18, the spring 38 in conjunction with the magnetic force will return the telescoping member 26 to the position shown in FIG. 1. The valve structure shown in FIG. 1 has an added advantage in that a siphon tube cannot be inserted into the fuel tank through the fill tube. Thus, an antisiphoning arrangement is provided along with the above-described selective fuel acceptance.

It should also be appreciated that due to the location of the diverter member 44, the telescoping member 26 cannot be moved manually by the insertion of an instrument through the tube 18 thus discouraging the use of devices such as funnels for permitting the introduction of leaded fuels into a fuel tank which should be restricted to unleaded fuels.

Obviously, many modifications and variations of the present invention are possible in light of the above teaching. It is therefore to be understood, that within the scope of the appended claims, the invention may be practiced otherwise than as specifically described.

The embodiments of the invention in which an exclusive property or privilege is claimed are defined as follows:

1. A valved filler pipe for a fuel tank comprising; a tubular member secured to and extending into said fuel tank; a nonmagnetic fill tube secured to the inner surface of said tubular member and spaced therefrom, said nonmagnetic fill tube having openings at both ends thereof; a telescoping tube member surrounding said nonmagnetic fill tube and being slidably disposed on said nonmagnetic fill tube in the space between said nonmagnetic fill tube and said tubular member, said telescoping tube member having a closed end adjacent one open end of said nonmagnetic fill tube, a radial opening spaced longitudinally from said closed end, and a magnetic collar; and spring means urging said telescoping tube member in a direction to close the one open end of said nonmagnetic fill tube, said telescoping tube being movable, against said spring means, to communicate said radial opening with said one open end of said nonmagnetic fill tube to permit the passage of fuel through said nonmagnetic fill tube into the fuel tank, said movement occurring in response to insertion into the nonmagnetic fill tube of a fuel fill nozzle carrying a rare earth magnet which magnetically couples with said magnetic collar.

2. A valve filler pipe for a fuel tank comprising; a tubular member secured to and extending into said fuel tank; a nonmagnetic fill tube secured to the inner surface of said tubular member and spaced therefrom, said nonmagnetic fill tube having an opening at one end adapted to receive a fuel nozzle; a telescoping tube member surrounding said nonmagnetic fill tube and being slidably disposed on said nonmagnetic fill tube in the space between said nonmagnetic fill tube and said tubular member; wall means on said telescoping tube member for closing the other end of said nonmagnetic fill tube when said telescoping tube is moved to one position; aperture means on said telescoping tube member for selectively opening the other end of said nonmagnetic fill tube; a magnetic collar secured to said telescoping tube member; and spring means urging said telescoping tube member to the one position so that the wall means will close the other end of said nonmagnetic fill tube, said telescoping tube being movable, against said spring means, to communicate said aperture means with the other end of said nonmagnetic fill tube to permit the passage of fuel through said nonmagnetic fill tube into the fuel tank, said movement occurring in response to insertion into the one end of the nonmagnetic fill tube of a fuel fill nozzle carrying a magnet which magnetically couples with said magnetic collar.

* * * * *